US005236045A

United States Patent [19]

Janezich et al.

[11] Patent Number: 5,236,045

[45] Date of Patent: Aug. 17, 1993

[54] HEAT EXCHANGER TUBE

[75] Inventors: Robert J. Janezich, Hibbing; Todd G. Dosen, Side Lake; Charles E. Cedar, Hibbing, all of Minn.

[73] Assignee: L & M Radiator, Inc., Hibbing, Minn.

[21] Appl. No.: 863,186

[22] Filed: Apr. 3, 1992

[51] Int. Cl.[5] ..... F28F 1/20

[52] U.S. Cl. ..... 165/183; 165/182

[58] Field of Search ..... 165/152, 181-183

[56] References Cited

U.S. PATENT DOCUMENTS

| | | | |
|---|---|---|---|
| 1,830,375 | 11/1931 | Shoop | 165/183 X |
| 3,190,352 | 6/1965 | Simpelaar | 165/183 X |
| 3,191,673 | 6/1965 | Young | 165/151 |
| 3,245,465 | 4/1966 | Young | 165/148 |
| 3,391,732 | 7/1968 | Murray | 165/76 |
| 3,993,125 | 11/1976 | Rhodes | 165/153 |
| 4,171,015 | 10/1979 | Bucey | 165/181 |

FOREIGN PATENT DOCUMENTS

| | | | |
|---|---|---|---|
| 886919 | 1/1955 | Fed. Rep. of Germany | 165/181 |
| 1136110 | 5/1957 | France | 165/181 |
| 1259266 | 3/1961 | France | 165/181 |
| 46224 | 7/1939 | Netherlands | 165/181 |
| 798128 | 7/1958 | United Kingdom | 165/181 |
| 864946 | 4/1961 | United Kingdom | 165/181 |
| 1312521 | 3/1970 | United Kingdom . | |

*Primary Examiner*—Allen J. Flanigan

*Attorney, Agent, or Firm*—Allegretti & Witcoff, Ltd.

[57] ABSTRACT

A heat exchanger tube having fin elements angled in an acute manner from a lateral axis of the flow tube to promote the deflection of debris. The heat exchanger may have a deflector element positioned between the fin elements to prevent the collection of debris between the fin elements.

19 Claims, 3 Drawing Sheets

HEAT EXCHANGER TUBE

BACKGROUND OF THE INVENTION

This invention relates generally to heat exchangers, and more particularly, to an improved heat exchanger tube for use in oil coolers or radiators. Typical heat exchangers are often employed to remove excess heat produced during operation of engines. Such heat exchangers often include a series of heat exchanger tubes through which a hot fluid flows. The heat exchanger tubes operate to reduce the temperature of the hot fluid which is then recirculated back into the engine.

Such heat exchanger tubes are often comprised of a finned section, hereinafter defined as that portion of a flow tube having fin elements, as well as adapter portions for insertion into a heat exchanger. Existing fin elements are generally rectangular and are attached along the flow tube. The heat from the hot fluid is transferred via the heat exchanger tubes to the surrounding atmosphere by the passing of air over the exterior surface area of the heat exchanger tubes. The fin elements increase surface area over which air may flow to maximize heat removal. The fin elements may be individual or they may take the form of corrugated fin strips attached laterally along the flow tube. As the surface area of the fin elements is increased, greater heat transfer occurs between the heat exchanger tube and its surroundings via the air flow, and therefore, a greater cooling effect of the fluid is achieved.

A problem encountered with existing heat exchanger tubes is that the length of the fin elements positioned laterally along the flow tube often exceed the diameter of the flow tube thereby creating a gap which tends to collect debris deposited by the flowing of air. Debris also collects on, and in between, the rectangular fin elements themselves, especially when corrugated fin strips are used. The buildup of debris often interferes with the transfer of heat from the heat exchanger tube to the surroundings resulting in inefficient cooling of the fluid. A heat exchanger tube is therefore desirable which minimizes buildup of such debris resulting in more efficient heat transfer and easier cleaning and maintenance of the heat exchanger.

SUMMARY OF THE INVENTION

Embodiments of the present invention include a novel heat exchanger tube designed to reduce buildup of debris at the finned section which may occur as a result of air flowing over the heat exchanger. Fin elements of the present invention are angled thereby providing a more streamlined fin element. Further, deflector elements are positioned within gaps created by certain fin elements so as to promote deflection of debris with which they may come in contact. The angled fin elements and the deflector elements greatly reduce the likelihood of debris buildup resulting in more efficient heat transfer from the heat exchanger tubes to the environment, as well as, easier cleaning and maintenance of the heat exchanger.

DESCRIPTION OF PREFERRED EMBODIMENTS

Embodiments of the present invention are seen in FIGS. 1–7. For purposes of describing degree of angling of fin elements of the present invention, FIGS. 2–6 have a lateral axis X, indicated by a dashed line and viewed from front to back of the embodiment, to reference the angling of the fin elements.

Figure 1:
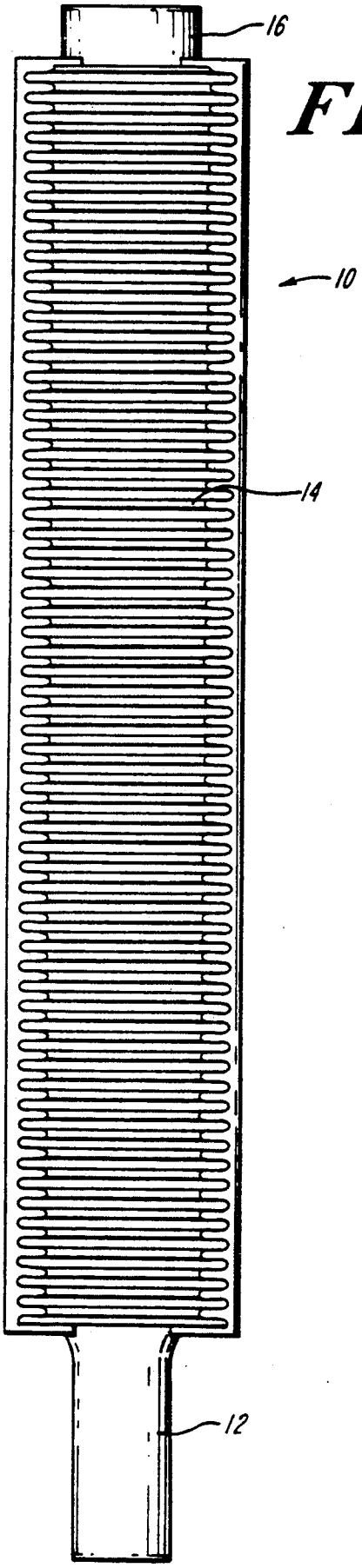
FIG. 1 is a side view of a heat exchanger tube in accordance with an embodiment of the present invention
Figure 2A:
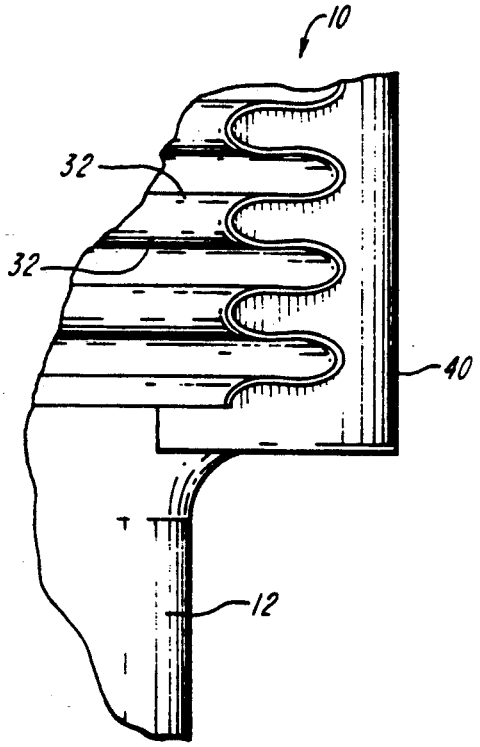
FIG. 2A is an enlarged partial side view of the heat exchanger tube of FIG. 1.
Figure 2:
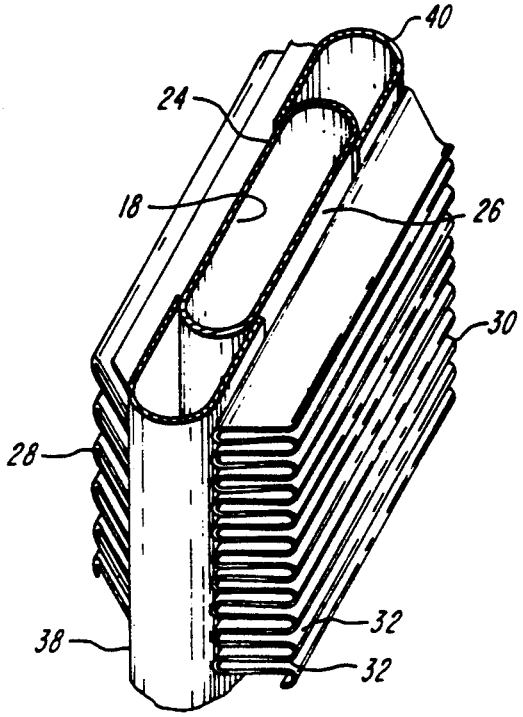
FIG. 2 is an enlarged perspective view of a cutaway portion of the heat exchanger tube of FIG. 1.

FIG. 1 is a side view of a heat exchanger tube seen generally at 10 having first section 12, finned section 14, and second section 16. First section 12 and second section 16 are unitary tubular extensions of flow tube 18, a cross-section of which is seen in FIG. 2, which extends through finned section 14. First section 12 is shown as being substantially cylindrical and second section 16 is shown as being substantially oblong. It is to be understood that first section 12 and second section 16 may be modified by those skilled in the art to allow insertion of heat exchanger tube 10 into a desired heat exchanger, such as a radiator. Such modifications may allow heat exchanger tube 10 to be either rigidly secured to, or removable from, the desired heat exchanger.

Referring to FIG. 2, which is a perspective view of a cutaway portion of flow tube 10 of FIG. 1 at finned section 14, flow tube 18 is substantially oblong at finned section 14 having approximately parallel sides 24 and 26. It is to be understood that flow tube 18 including first section 12 and second section 16 may be entirely cylindrical or oblong or any combination thereof. Flow tube 18 is preferably formed from metals having desirable heat transfer properties, such as copper, however it is to be understood that flow tube 18 may be formed from any material suitable for operation within a heat exchanger.

Figure 6:
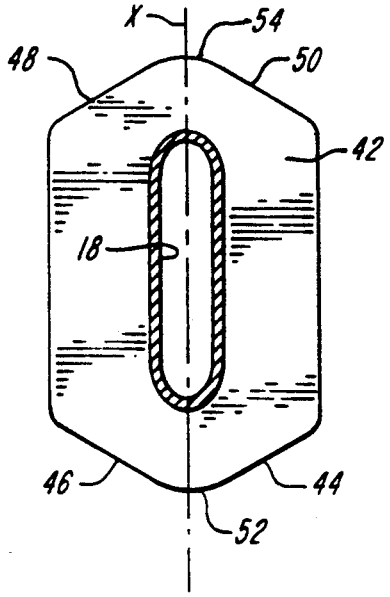

First and second corrugated fin strips 28 and 30 are each fixedly mounted to, and extend laterally along, approximately parallel sides 24 and 26, respectively, of flow tube 18. First and second corrugated fin strips 28 and 30 are folded back and forth to form a plurality of fin elements 32. As illustrated in FIG. 2 and FIG. 2A which is an enlarged partial side view of heat exchanger tube 10, fin elements 32 of each corrugated fin strip are unitary and are essentially parallel to one another to form a plurality of stacked surfaces over which air may flow. First and second corrugated fin strips 28 and 30 are preferably formed from metals having desirable heat transfer properties, such as copper, however, it is to be understood that they may be formed from any suitable material having desirable heat transfer properties. It is to be further understood that a plurality of individual fin elements may be fixedly mounted to flow tube 18 instead of the unitary fin elements 32 of first and second corrugated fin strips 28 and 30. The individual fin elements may be fixedly mounted to, and extend laterally along, approximately parallel sides 24 and 26, respectively, of flow tube 18, or they may encircle flow tube 18 as illustrated by the embodiment of FIG. 6.

Figure 3:
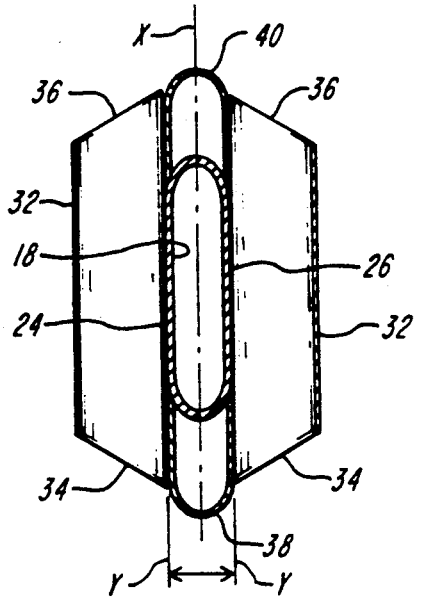
FIG. 3 is an enlarged top view of the heat exchanger tube of FIG. 1, partially in cross section.

As can be seen in FIG. 3, which is a top view, partially in cross section, of heat exchanger tube 10 of FIG. 1 at finned section 14, fin elements 32 are positioned laterally along flow tube 18 at approximately parallel sides 24 and 26 though not necessarily directly aligned across from one another. Lateral axis X is indicated as a dashed line viewed from the front to the back of the embodiment to reference the angling of fin elements 32. Fin elements 32 have frontside 34 and backside 36, with frontside 34 of each fin element 32 extending beyond flow tube 18 thereby forming a first gap, the width of which is indicated in FIG. 3 by the arrow extending between lines Y. As can be seen in FIG. 3, frontside 34 is angled in an acute manner relative to lateral axis X. Degree of angle of frontside 34 relative to lateral axis X may be any suitable degree, such as between 30 degrees to 60 degrees. The angling encourages debris to glance off of fin elements 32 and more easily pass between adjacent heat exchanger tubes when arranged within, for example, a radiator, thereby reducing buildup of debris. A preferred degree angle for frontside 34 is approximately 45 degrees relative to lateral axis X. In a preferred embodiment as indicated in FIG. 3, frontside 34 is essentially flat and beveled with respect to lateral axis X.

Backside 36 of fin elements 32 extend beyond flow tube 18 thereby forming a second gap similar to the first gap previously described. As illustrated in FIG. 3, backside 36 of fin elements 32 are angled in a manner similar to frontside 34, i.e. in an acute manner relative to lateral axis X. Angling of both frontside 34 and backside 36 of fin elements 32 is desirable when heat exchanger tubes of the present invention are subject to flow of air from both front and back directions. In a preferred embodiment as indicated in FIG. 3, backside 36 is essentially flat and beveled with respect to lateral axis X.

As indicated in FIG. 2 and in cross-section in FIG. 3, first unitary deflector element 38 is essentially a U-shaped strip fixedly mounted within the first gap between first and second corrugated fin strips 28 and 30 and having a bowed section extending slightly beyond frontside 34. First unitary deflector element 38 is fixedly mounted to flow tube 18 or first and second corrugated fin strips 28 and 30. First unitary deflector element 38 may be formed from any suitable material as its primary function is to deflect debris, however, it is preferably formed from metals having desirable heat transfer properties, such as copper. As indicated in FIGS. 2 and 3, second unitary deflector element 40 is similar in design to first unitary deflector element 38 and is fixedly mounted within the second gap between first and second corrugated fin strips 28 and 30 and having a bowed section extending slightly beyond backside 36. Second unitary deflector element 40 is fixedly mounted to flow tube 18 or first and second corrugated fin strips 28 and 30. Second unitary deflector element 40 may be formed from any suitable material as its primary function is to deflect debris, however, it is preferably formed from metals having desirable heat transfer properties, such as copper. The angled fin elements and the U-shaped deflector elements produce a streamlined finned section to promote the deflection of debris.

Figure 4:
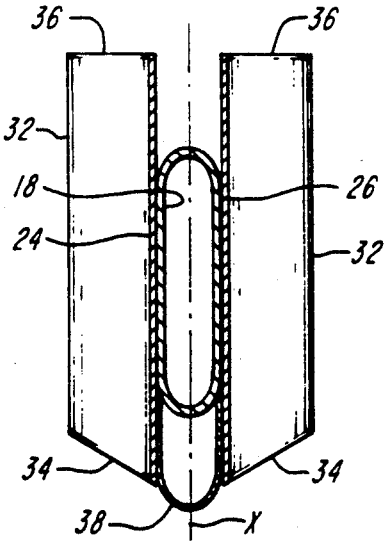
FIGS. 4, 5 and 6 are top views, partially in cross section, of heat exchanger tubes in accordance with alternate embodiments of the present invention.

FIG. 4 is a top view, partially in cross section, of an alternate embodiment of the present invention and uses the same numbering scheme as FIG. 3. In FIG. 4, frontside 34 is angled in an acute manner relative to lateral axis X, similar to frontside 34 as illustrated in FIG. 3, however, backside 36 projects in a rectangular manner. First unitary deflector element 38 is fixedly mounted within the first gap similar to that illustrated in FIG. 3. The alternate design of FIG. 4 contemplates flow of air primarily in a direction toward first unitary deflector element 38 and over fin elements 32

Figure 5:
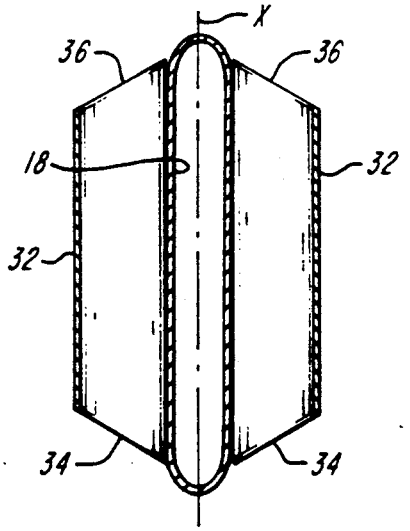

FIG. 5 is a top view, partially in cross section, of an alternate embodiment of the present invention and uses the same numbering scheme as FIG. 3. Fin elements 32 are designed similar to that previously described with respect to FIG. 3, however, flow tube 18 extends beyond frontside 34 and backside 36 replacing first and second unitary deflector elements 38 and 40 of FIG. 3. The alternate design of FIG. 5 increases the surface area of flow tube 18 imparting greater fluid flow properties and heat transfer efficiency desirable in certain heat exchangers.

Figure 7:
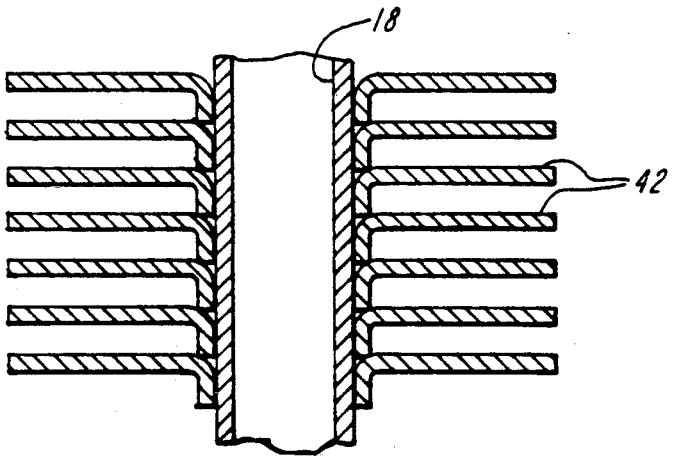
FIG. 7 is an enlarged cutaway portion of the heat exchanger tube of FIG. 6 in cross-section.

FIG. 6 is a top view, partially in cross section, of an alternate embodiment of the present invention. In FIG. 6, fin element 42 is an individual fin element fixedly mounted to and encircling flow tube 18 in a wrap around fashion. Fin element 42 has frontsides 44 and 46, backsides 48 and 50, front portion 52 and back portion 54. Front sides 44 and 46 are angled in an acute manner relative to lateral axis X as previously described with respect to frontside 34 of FIG. 3. Similarly, backsides 48 and 50 are angled in an acute manner relative to lateral axis X as previously described with respect to backside 36 of FIG. 3. Front portion 52 and back portion 54 are rounded so as to promote deflection of debris. As indicated in FIG. 7, which is an enlarged partial front view in cross-section of the embodiment of FIG. 6, a plurality of fin elements 42 are fixedly mounted in a parallel fashion along flow tube 18 and are stacked approximately equidistant from one another.

It is to be understood that the embodiments of the invention which have been described are merely illustrative of some applications of the principles of the invention. Numerous modifications may be made by those skilled in the art without departing from the true spirit and scope of the invention.

What is claimed is:

1. A heat exchanger tube comprising, a flow tube having a lateral axis transverse to the length of the flow tube along which the dimension of the flow tube in cross-section is at a maximum, and having a plurality of fin elements separate from the flow tube with the fin elements being fixedly mounted to the flow tube; and each of the fin elements being of uniform thickness and having a frontside and a backside, the frontside and the backside connected by a substantially unbroken surface, with an outer edge of the surface being substantially parallel to the lateral axis, the frontside of each of the fin elements being angled in an acute manner relative to a portion of the lateral axis living inside the flow tube.

2. The heat exchanger tube of claim 1 wherein the frontside of each fin element is angled between about 30 degrees to about 60 degrees relative to the lateral axis of the flow tube.

3. The heat exchanger tube of claim 2 wherein the frontside of each fin element is angled about 45 degrees relative to the lateral axis of the flow tube.

4. The heat exchanger tube of claim 3 wherein the backside of each fin element is angled in an acute manner relative to the lateral axis of the flow tube 5. The heat exchanger tube of claim 4 wherein the backside of each fin element is angled between about 30 degrees to about 60 degrees relative to the lateral axis of the flow tube.

6. The heat exchanger tube of claim 5 wherein the backside of each fin element is angled about 45 degrees relative to the lateral axis of the flow tube.

7. The heat exchanger tube of claim 6 wherein the flow tube being oblong and extending slightly beyond the frontside and backside of each fin element.

8. The heat exchanger tube of claim 6 wherein each fin element is an individual fin element which encircles the flow tube.

9. The heat exchanger tube of claim 6 wherein the fin elements are positioned laterally along opposite sides of the flow tube with the frontside extending beyond the flow tube thereby forming a first gap.

10. The heat exchanger tube of claim 9 further comprising a first unitary deflector element fixedly mounted within the first gap and extending beyond the frontside of the fin elements.

11. The heat exchanger tube of claim 10 wherein the backside of the fin elements extends beyond the flow tube thereby forming a second gap.

12. The heat exchanger tube of claim 11 further comprising a second unitary deflector element fixedly mounted within the second gap and extending beyond the backside of the fin elements.

13. The heat exchanger tube of claim 12 wherein the first and second unitary deflector elements are U-shaped strips having a bowed section extending beyond the frontside and the backside respectively of the fin elements.

14. The heat exchanger tube of claim 13 wherein the plurality of fin elements comprise first and second corrugated fin strips, the fin strips being folded back and forth to form the plurality of fin elements.

15. A heat exchanger tube comprising, a flow tube having a lateral axis transverse to the length of the flow tube along which the dimension of the flow tube in cross-section is at a maximum and having a plurality of fin elements fixedly mounted to the flow tube;

each of the fin elements having a frontside and a backside, the frontside of each of the fin elements being angled in an acute manner relative to the lateral axis of the flow tube to promote deflection of debris, the fin elements being positioned laterally along opposite sides of the flow tube with the frontside extending beyond the flow tube thereby forming a first gap, the backside extending beyond the flow tube thereby forming a second gap, the backside of each fin element being angled in an acute manner relative to the lateral axis of the flow tube;

first unitary deflector element fixedly mounted within the first gap and extending beyond the frontside of the fin elements; and, second unitary deflector element fixedly mounted within the second gap and extending beyond the backside of the fin elements, the first and second unitary deflector elements being U-shaped strips, each having a bowed section extending beyond the frontside and the backside respectively of the fin elements.

16. The heat exchanger tube of claim 15 wherein the frontside of each fin element is angled between about 30 degrees to about 60 degrees relative to the lateral axis of the flow tube.

17. The heat exchanger tube of claim 16 wherein the frontside of each fin element is angled about 45 degrees relative to the lateral axis of the flow tube.

18. The heat exchanger tube of claim 17 wherein the plurality of fin elements comprise first and second corrugated fin strips, the fin strips being folded back and forth to form the plurality of fin elements.

19. A heat exchanger tube comprising, a substantially oblong flow tube having a plurality of fin elements fixedly mounted to the flow tube, the plurality of fin elements comprising first and second corrugated fin strips, the fin strips being folded back and forth to form the plurality of fin elements, each of the fin elements having a frontside and a backside, the frontside of each of the fin elements being angled between about 30 degrees to about 60 degrees relative to the lateral axis of the flow tube, preferably about 45 degrees, to promote deflection of debris, the fin elements being positioned laterally along opposite sides of the flow tube with the frontside extending beyond the flow tube thereby forming a first gap, the backside extending beyond the flow tube thereby forming a second gap, the backside of each fin element being angled between about 30 degrees to about 60 degrees relative to the lateral axis of the flow tube, preferably about 45 degrees, to promote deflection of debris, first unitary deflector element fixedly mounted within the first gap and extending beyond the frontside of the fin elements; and, second unitary deflector element fixedly mounted within the second gap and extending beyond the backside of the fin elements, the first and second unitary deflector elements being U-shaped strips, each having a bowed section extending beyond the frontside and the backside respectively of the fin elements.

* * * * *